US005800311A

United States Patent [19]

Chuang

[11] Patent Number: 5,800,311

[45] Date of Patent: Sep. 1, 1998

[54] WRIST EXERCISER

[76] Inventor: P. S. Chuang, No. 20, Alley 13, Lane 122, Dan Shui Town, Taipei Hsien, 251, Taiwan

[21] Appl. No.: 984,043

[22] Filed: Dec. 3, 1997

[30] Foreign Application Priority Data

Jul. 25, 1997 [TW] Taiwan ..... 86212568

[51] Int. Cl.[6] ..... A63B 5/00

[52] U.S. Cl. ..... 482/44; 482/2; 482/45; 482/49; 601/33

[58] Field of Search ..... 482/1, 2, 4, 5, 482/44, 45, 49, 50, 92, 106, 108, 135–137, 902; 601/23, 33, 40

[56] References Cited

U.S. PATENT DOCUMENTS

| | | | |
|---|---|---|---|
| 4,858,912 | 8/1989 | Boyd | 482/45 |
| 5,263,908 | 11/1993 | Chen | 482/44 |
| 5,267,921 | 12/1993 | Roehik | 482/44 |

*Primary Examiner*—Glenn Richman
*Attorney, Agent, or Firm*—Rosenberg, Klein & Bilker

[57] ABSTRACT

A wrist exerciser includes a spherical hollow casing having a top opening and a bottom opening. A ring is received within the casing and substantially coincident with a great circle of the casing and concentric with and rotatable about a first axis of the casing. A rotor is received within the ring and rotatably supported on the ring, having a central bore coaxial with and rotatable about a second axis of the casing that is substantially normal to the first axis. The rotor has a circumferential groove formed on the outer surface thereof with light emitting diodes (LEDs) equally spaced therein. A magnet is also disposed in the groove. The central bore of the rotor is partitioned into chambers which cause sound during the rotation of the rotor. A generator includes a ring magnet fixed to the ring and coaxial with the second axis and two coils fixed to the rotor and corresponding to the ring magnet for generating electrical current to power the LEDs during the rotation of the rotor by cutting through magnetic line of force of the ring magnet. A counter is attached to the bottom opening of the casing, including a proximity detector actuateable by the magnet in the groove and a photo sensor actuateable by the light of the LEDs which respectively detect the rotations of the rotor at different speed ranges. A rope is windable around the groove via the top opening of the casing for driving the rotor to rotate.

20 Claims, 5 Drawing Sheets

WRIST EXERCISER

BACKGROUND OF THE INVENTION

1. Field of the Invention

The present invention relates generally to a wrist exerciser to be rotated by a user with his or her palm and wrist and in particular to a wrist exerciser incorporating a counter to counting the turns of the rotation and having light generation device to emit light during the rotation for a more appealing attraction to the general consumers.

2. Related Arts

A wrist exerciser is a spherical article to be held in a user's palm and rotated by the user with the wrist associated with the palm that holds the exerciser. A conventional wrist exerciser is shown in FIG. 5 of the attached drawings, broadly designated with reference numeral 70, comprising a hollow spherical casing 71 having an access opening 72. The casing 71 has a ring 73 therein concentric with and rotatable about a first axis of the spherical casing 71. A rotor 74 is received within the ring 73 and rotatably supported thereby so as to be rotatable with respect to the ring 73 about a second axis of the spherical casing 71 that is substantially normal to the first axis. A circumferential groove 75 is provided along the outer, spherical surface of the rotor 74 on a plane substantially normal to the second axis. A hole 76 is provided within the groove 75. A flexible rope 78 has a rigid end 77 receivable in and engageable with the hole 76 is wound around the groove 75 via the access opening 72. In operation, the user holds the wrist exerciser 70 with one hand and fast pulling to unwind the rope 78 from the rotor 74 so as to cause the rotor 74 to rotate inside the casing 71. The user may then use his hand, particularly the wrist, to control and rotate the wrist exerciser in order to keep the rotation of the rotor 74 and thus achieve the objects of exercising the wrist and also for making fun.

Such a conventional wrist exerciser has certain disadvantages. For example, the conventional wrist exerciser is not provided with a counter to show the turns that the user rotates the rotor. Further, such a conventional wrist exerciser provides only simple rotation of the rotor which may not be appealing enough to the general consumers. The reduction in the rotational speed of the rotor is also hard to know by the user.

It is thus desirable to have improvements over the conventional wrist exerciser of the kind discussed above so as to overcome the problems encountered in the prior art.

SUMMARY OF THE INVENTION

Therefor, an object of the present invention is to provide a wrist exerciser which comprises a counter to count the turns of rotation of the rotor for the provision of an exercise amount indication to the user.

Another object of the present invention is to provide a wrist exerciser which comprises a light generation device mounted to the rotor of the wrist exerciser to emit light during the rotation of the rotor for a more appealing attraction to the general consumers.

A further object of the present invention is to provide a wrist exerciser wherein the rotor is provided with a central bore which is partitioned into separate chambers that generate sounds during the rotation of the rotor due to the air flow in/out of the chambers.

A further object of the present invention is to provide a wrist exerciser which comprises a plurality of light emitting diodes arranged in an equally spaced manner around the rotor which emit light during the rotation of the rotor of which the light intensity is dependent upon the rotational speed of the rotor so as to serve as an indication of the rotational speed of the rotor.

Yet a further object of the present invention is to provide a wrist exerciser which comprises an electrical generator comprised of a pair of coils of conductive wires rotatable in unison with the rotor and a magnet that is stationary with respect to the rotor so that the rotation of the rotor induces an electrical current in the coils to power the light generation device due to the coils' cutting through of the magnetic line of force of the magnet.

A further object of the present invention is to provide a wrist exerciser that comprises lighting elements which emit light having an intensity depending upon the rotational speed of the rotor so as to be more appealing to the general consumers.

To achieve the above objects, in accordance with the present invention, there is provided a wrist exerciser comprising a spherical hollow casing having a top opening and a bottom opening. A ring is received within the casing and substantially coincident with a great circle of the casing and concentric with and rotatable about a first axis of the casing. A rotor is received within the ring and rotatably supported on the ring, having a central bore coaxial with and rotatable about a second axis of the casing that is substantially normal to the first axis. The rotor has a circumferential groove formed on the outer surface thereof with light emitting diodes (LEDs) equally spaced therein. A magnet is also disposed in the groove. The central bore of the rotor is partitioned into chambers which cause sound during the rotation of the rotor. A generator comprises a ring magnet fixed to the ring and coaxial with the second axis and two coils fixed to the rotor and corresponding to the ring magnet for generating electrical current to power the LEDs during the rotation of the rotor by cutting through magnetic line of force of the ring magnet. A counter is attached to the bottom opening of the casing, comprising a proximity detector actuateable by the magnet in the groove and a photo sensor actuateable by the light of the LEDs which respectively detect the rotations of the rotor at different speed ranges of the rotor. A rope is windable around the groove via the top opening of the casing for driving the rotor to rotate.

BRIEF DESCRIPTION OF THE DRAWINGS

The present invention will be better understood from the following description of a preferred embodiment thereof, with reference to the attached drawings, wherein.

DETAILED DESCRIPTION OF THE PREFERRED EMBODIMENT

Figure 1:
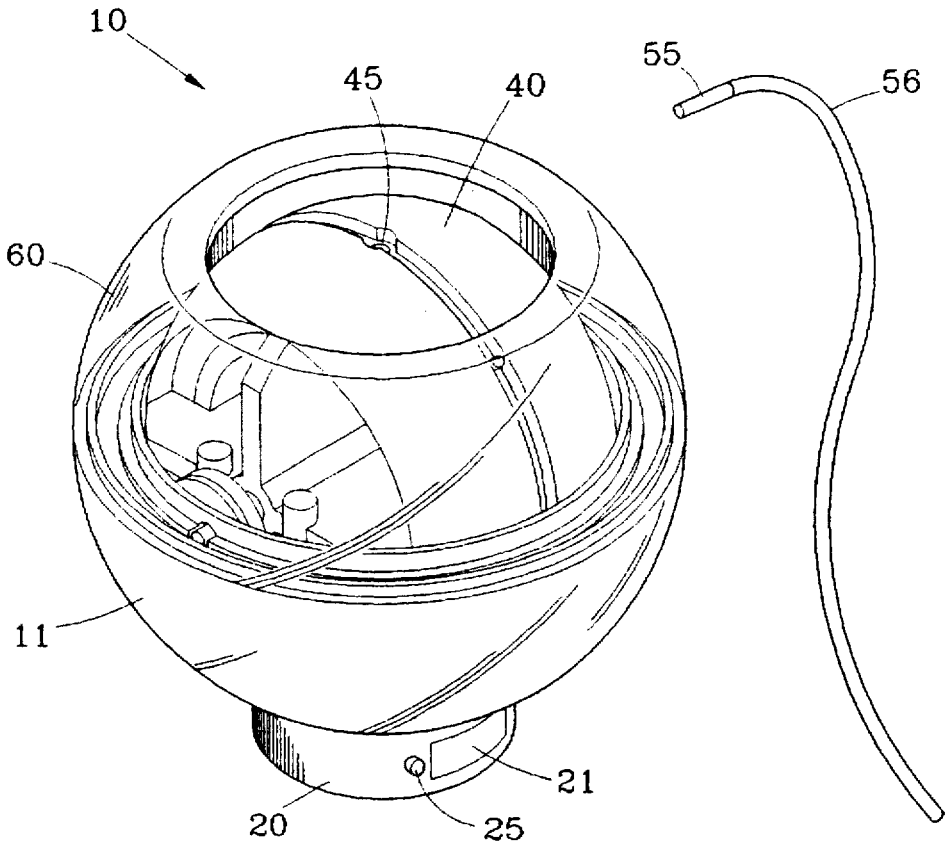
FIG. 1 is a perspective view showing a wrist exerciser constructed in accordance with the present invention.
Figure 2:
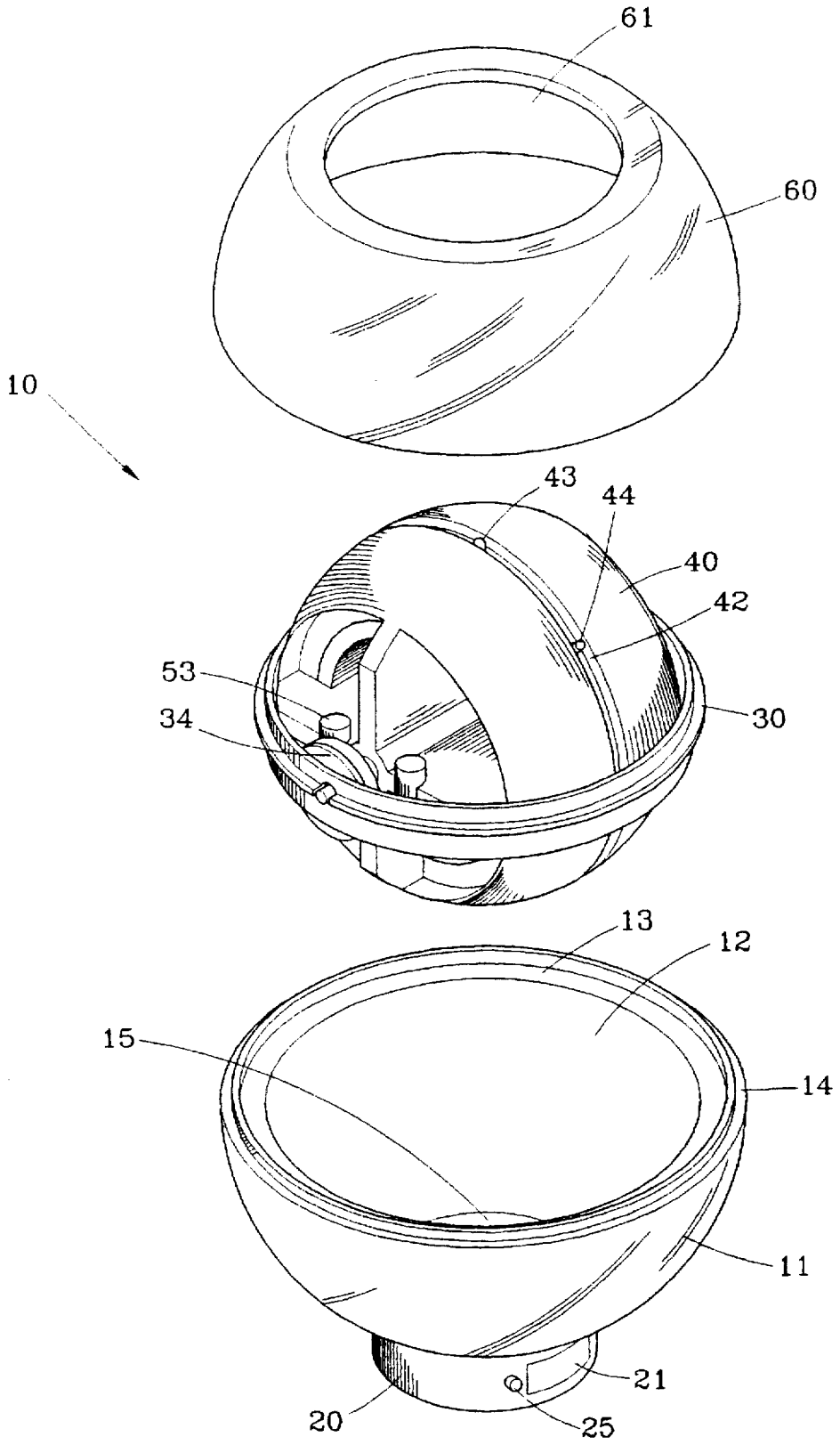
FIG. 2 is an exploded perspective view of the wrist exerciser of the present invention.
Figure 3:
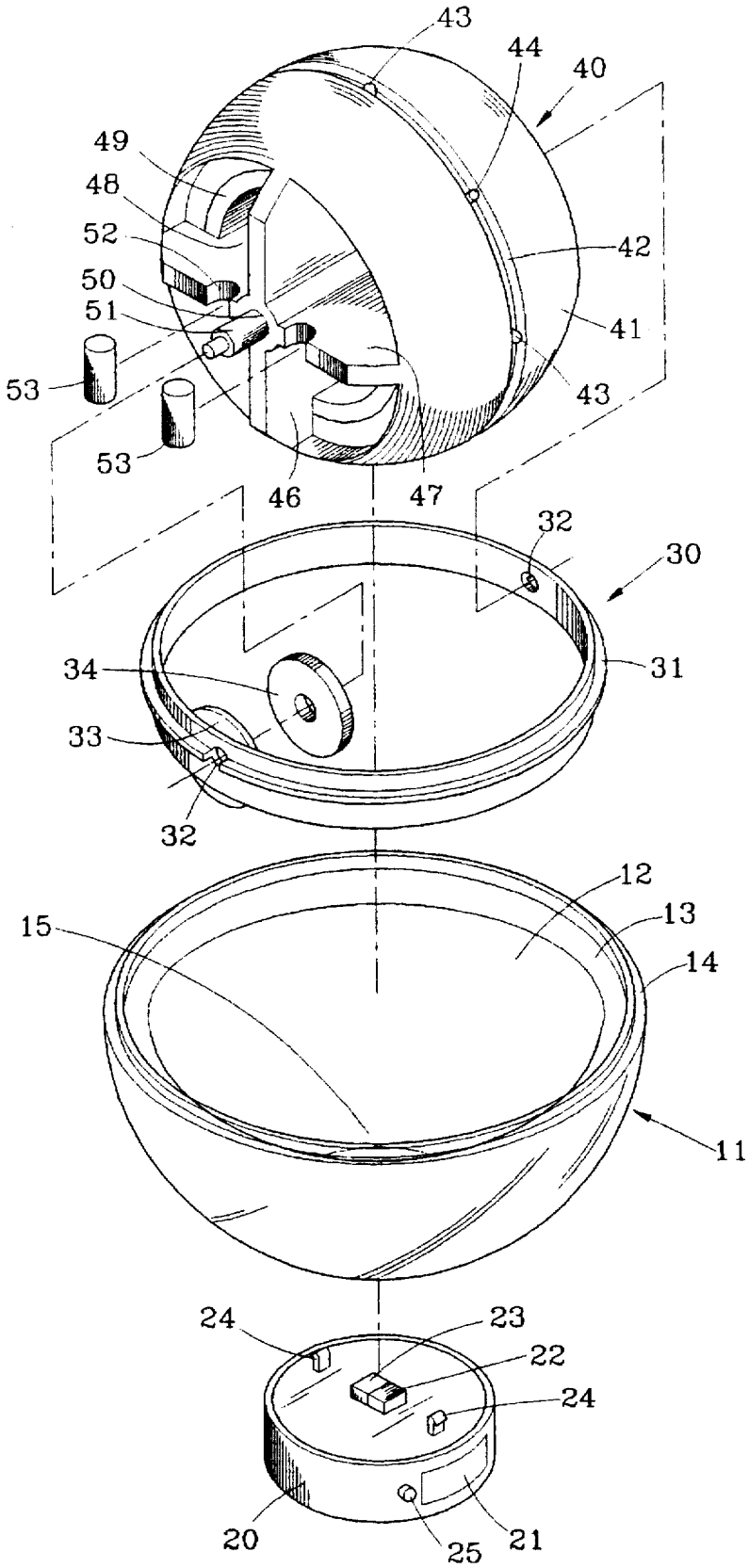
FIG. 3 is another exploded perspective view of the wrist exerciser of the present invention, showing the structure of the rotor, with the upper member of the casing being removed for simplicity.

With reference to the drawings and in particular to FIGS. 1, 2 and 3, wherein a wrist exerciser constructed in accordance with the present invention, generally designated with reference numeral 10, is shown, the wrist exerciser 10 comprises a spherical casing constituted by a lower member 11 and an upper member 60 both being substantially hemispherical and connected to each other to define a hollow spherical structure inside which a ring 30 is received and rotatable about a first axis of the sphere and a rotor 40 rotatably supported within the ring 30 and rotatable about a second axis of the sphere which is substantially normal to the first axis. A counter 20 is selectively provided and attached to a bottom opening 15 of the lower member 11 which is located substantially opposite to the upper casing member 60.

The lower casing member 11 which is substantially hemispherical comprises a hollow interior 12 for the disposition of the rotor 40 having a top opening which is substantially corresponding to a great circle of the sphere of the wrist exerciser 10 and opposite to the bottom opening 15 of the lower casing member 11. The top opening of the lower casing member 11 comprises an inner circumferential shoulder 13 extending along the top opening to define a lower race for movably supporting the ring 30. The top opening of the lower casing member 11 is also provided with an outer circumferential shoulder 14 for receiving and supporting a bottom flange of the upper casing member 60 that is corresponding to the top opening of the lower casing member 11 so as to form the sphere.

The counter 20 is releasably attached to the bottom opening 15 of the lower casing member 11 and communicates with the interior 12 of the sphere via the bottom opening 15 so as to count the turns of rotation of rotor 40.

In the embodiment illustrated, the counter 20 is made as a circular disk like configuration having a top side and an opposite bottom side with a circumferential lateral side connecting therebetween. A display 21 is provided on the circumferential lateral side thereof as illustrated. Alternatively, the display 21 may be provided on the bottom side of the counter 20. The display 21 is to show the number of turns of the rotation of the rotor 40. Preferably a reset button 25 is provided next to the display 21 to reset the display 21. Cells or batteries (not shown) may be provided to power the display 21.

The counter 20 comprises sensing means on the top side thereof, including a photo sensor 22 and a proximity detector 23 which are respectively photically and magnetically actuateable so as to detect a photo signal and a magnetic signal generated in each turn of rotation of the rotor 40 in order to count the turns of rotation of the rotor 40. Fastening means, such as a pair of paws 24 that are engageable with edges of the bottom opening 15 of the lower casing member 11, is provided on the top side of the counter 20 for releasably attaching the counter 20 to the lower casing member 11. The photo sensor 22 and the proximity detector 23 are located corresponding to the rotor 40 in such a way that each time the rotor 40 makes a turn, the sensing means is actuated once so as to count the turns of rotation of the rotor 40.

The ring 30 comprises a circumferential outward flange 31 to be movably supported on the lower race defined by the inner shoulder 13 of the lower casing member 11. The ring 30 also has two diametrically opposite holes 32 aligned with each other along the second axis of the sphere of the casing. One of the holes 32 has a ring-like insulation pad 33 and a permanent magnet ring 34 securely fixed thereto and coaxial with the hole 32.

The rotor 40 has a hollow cylindrical body 41 having a spherical outside surface corresponding to and substantially concentric to the spherical configuration of the upper and lower casing members 60 and 11 to be rotatably received therein and a central bore extending substantially along the second axis. At least one partition plate and preferably a pair of partition plates 46 and 47, preferably normal to each other, are fixed within the central bore of the rotor body 41 to divide the bore of the rotor body 41 into four chambers 48, each having a weight block 49 fixed therein to increase the moment of inertia and thus the centrifugal force generated thereby during the rotation of the rotor 40. Quite apparently, there may be more than two such partition plates to divide the central bore of the body 41 into separate chambers. The chambers 48 also serve as resonant means which magnifies the sound caused by air flow in/out of the chambers 48 when the rotor 40 is rotating.

The partitions 46 and 47 intersect each other to define a central axis of the rotor 40 along which a bore 50 concentric with the central bore of the rotor body 41 is formed to receive and fix therein a shaft 51 having two ends extending out of the bore 50 and rotatably supported within the diametrically opposite holes 32 of the ring 30 so as to allow the rotor 40 to be rotatable with respect to the ring 30. The rotation of the rotor 40 is also made with respect to the magnet ring 34 as the magnet ring 34, as well as the insulation pad 33, is securely fixed to the ring 30. On one of the partition plates, for example the partition plate 47, two notches 52 are formed on two opposite sides of the central axis of the rotor 40 to each receive and fix therein a coil of conductive wire 53. The coils 53 are arranged in such a way to cut though the magnetic line of force of the magnet ring 34 when the rotor 40 is rotating, thus inducing an electrical current in the coils 53. The coils 53 and the magnet 34 together form an electrical generator.

The rotor 40 has formed on the outside surface thereof a circumferential groove 42 which is located on a great circle of the spherical outside surface thereof that is substantially perpendicular to the second axis of the spherical casing that is the central axis of the rotor 40 defined by the intersection of the two partitions 46 and 47 in the embodiment illustrated. A plurality of the lighting elements 43, preferably light emitting diodes (LEDs), are arranged within the groove 42, preferably in an equally-spaced manner. The lighting elements 43 are electrically connected to the coils 53 so that when an electrical current is induced in the coils 53 caused by the rotation of the rotor 40 with respect to the ring 30, the lighting elements 43 are powered to emit lights. Apparently, the fast the rotation of the rotor 40, the greater the electrical current induced in the coils 53 and the more intense the light generated by the lighting elements 43. This provides an indication for the rotational speed of the rotor 40. In accordance with a preferred embodiment of the present invention, there are four such lighting elements 43 equally spaced along the groove 42. Within the groove 42, there is also a magnet 44 received and fixed.

Figure 4:
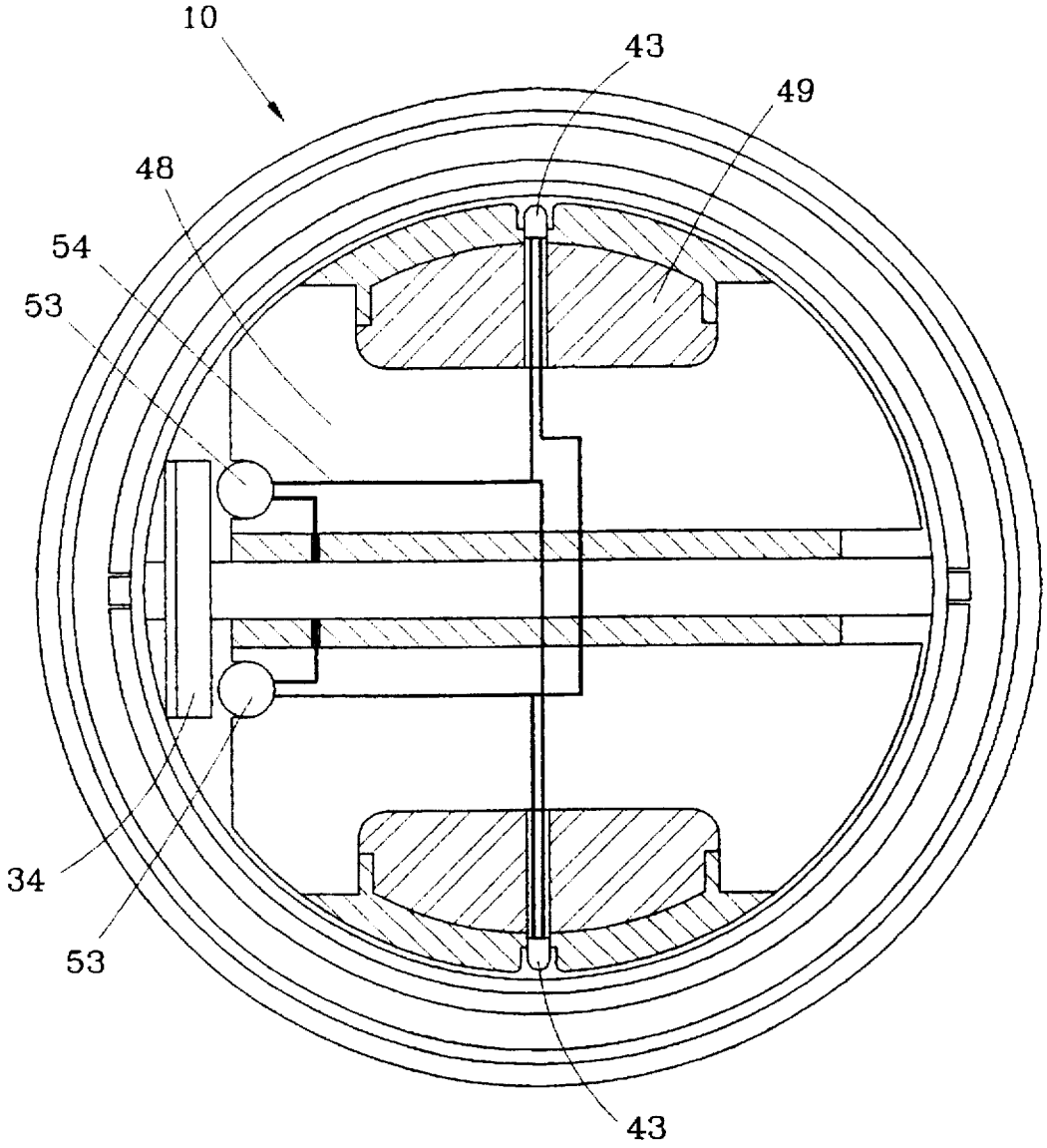
FIG. 4 is cross-sectional view of the wrist exerciser of the present invention showing an exemplary electrical connection between the lighting elements and the generator coils.
Figure 5:
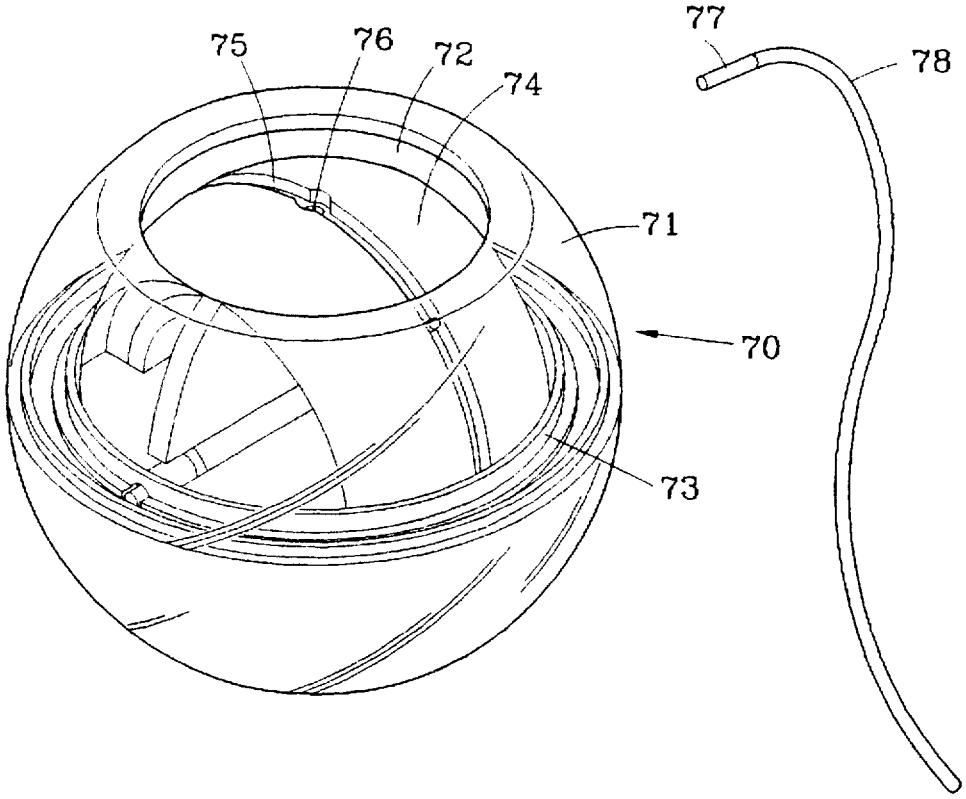
FIG. 5 is a perspective view showing a prior art wrist exerciser.

FIG. 4 shows an example of the connection between the coils 53 and the lighting elements 43. The coils 53 may be connected to each other in series, defining two opposite terminal contacts which are connected to a circuit formed by connecting the lighting elements 43 in parallel.

The rotor 40 is rotatably supported within the sphere defined by the upper and lower casing members 60 and 11 so that the groove 42 of the rotor 40 is corresponding to the sensing means of the counter 20 and the rotation of the rotor 40 brings the lighting elements 43 and the magnet 44 to pass through and actuate the photo sensor 22 and the proximity detector 23. Both the photo sensor 22 and the proximity detector 23 provide the same counting function and yet they are applicable in different speed ranges of the rotor 40. For example, when the rotor 40 rotates slowly, the current induced in the coils 53 is small and the light generated by the lighting elements 43 is weak so that it may not be sufficient to actuate the photo sensor 22. In this case, the counting function is provided by the proximity detector 23 which is actuated by the magnet 44 that is rotated with the rotor 40 to pass through the proximity detector 23 each time when the rotor 40 makes a full turn about the shaft 51. When the rotor 40 speeds up, the proximity detector 23 is no longer able to catch the rotation of the rotor 40 and in this case, the current induced in the coils 53 is large enough to cause a strong light on the lighting elements 43 which actuate the photo sensor 22. In accordance with the present invention, the photo sensor 22 senses each of the lighting elements 43 when the rotor 40 is rotating and, based on the number of the lighting elements 43 that are disposed inside the groove 42, the number of turns of the rotation of the rotor 40 may be calculated.

The upper casing member 60 which is also a hemispherical member is connected to the lower casing member 11 to define the spherical casing by having the an outer circumferential edge of the bottom opening of the upper casing member 60 supported on and fixed to the outer shoulder 14 of the lower casing member 11. The outer circumferential edge of the upper casing member 60 may be fixed to the outer shoulder 14 of the lower casing member 11 by any known means, such as adhesives or ultra-sonic welding technique. The bottom opening of the upper casing member 60 also has an inner circumferential edge corresponding to the inner shoulder 13 of the top opening of the lower casing member 11 to define an upper race for the ring 30. The lower race and upper race of the ring 30 are arranged to support the outward flange 31 of the ring 30 therein and to allow the ring 30 to rotate about the first axis of the spherical casing which extends through the centre of the ring 30.

The upper casing member 60 is provided with a top opening 61 which serves as a user access opening, allowing a user to plug a rigid end 55 of a flexible rope 56 (see FIG. 1) into a driving hole 45 which is formed in the groove 42 of the rotor 40 and to wind the rope 56 around the rotor 40 along the groove 42. By holding the spherical casing of the wrist exerciser 10 with one hand and fast pulling to unwind the rope 56 out of the groove 42 with the other hand, the user may drive the rotor 40 to rotate about the shaft 51. The weight blocks 49 fixed inside the chambers 48 of the rotor 40 which increase the moment of inertia of the rotor 40 maintain the rotation of the rotor 40 and the user may use his or her wrist to rotate the spherical casing of the wrist exerciser 10 and control and elongate the rotation of the rotor 40. During the rotation of the rotor 40, the lighting elements 43 generate light and the chambers 48 magnify the sound caused by air flowing therethrough and thus give off a loud sound. This provides a more appealing sound and light attraction for general consumers.

In accordance with a preferred embodiment of the present invention, the lighting elements 43 are LEDs which consumes very tiny electricity so that the generator consisting of the coils 53 and the magnet 34 is sufficient to support the lightening of the LEDs. Furthermore, the LEDs 43 may be differently colored which is even more appealing to general consumers.

Although it is described in the above that the counter 20 is made as a circular disk, yet it is apparent to those having ordinary skill to make the counter 20 as any desired shape, such as an ellipse or a semicircle. Further, if desired, the counter 20 may be completely eliminated in the wrist exerciser 10 of the present invention.

The above description is made with respect to the preferred embodiment of the present invention and for those skilled in the art, it is possible to make a variety of modifications and changes to the above-described specific embodiment without departing from the scope and spirit of the present invention. All these modifications and changes should be considered within the scope of the present invention as defined in the appended claims.

What is claimed is:

1. A wrist exerciser comprising a spherical casing having a first axis and a second axis substantially perpendicular to each other, a ring received within the spherical casing to be concentric with and rotatable about the first axis with respect to the casing and a spherical rotor received within the ring and having a rotational axis co-linear with the second axis to be rotatable about the second axis with respect to both the casing and the ring, the rotor having an outer surface on which a circumferential groove is formed with a driving hole formed in the groove, a flexible rope having a rigid end receivable in and engageable with the driving hole. The flexible rope being windable around the outer surface of the rotor along the groove through a top opening formed on the casing so that the rotor is driven to rotate about the second axis by pulling to unwind the rope from the rotor, light generation means mounted on the rotor to emit light during the rotation of the rotor.

2. The wrist exerciser as claimed in claim 1, wherein the light generation means comprises electrically driving lighting elements disposed in the groove and electrical generator means which supplies an electrical current to the lighting elements.

3. The wrist exerciser as claimed in claim 2, wherein the generator means comprises at least one coil of conductive wire fixed on the rotor to be in electrical connection with the lighting elements and a magnet fixed to the ring and having magnetic line of force, the magnet being positioned corresponding to the coil so that the rotation of the rotor moves the coil to cut through the magnetic line of force of the magnet and thus induce an electrical current in the conductive wire of the coil which is supplied to light the lighting elements.

4. The wrist exerciser as claimed in claim 3, wherein the generator means comprises two coils provided on two opposite sides of the rotational axis of the rotor.

5. The wrist exerciser as claimed in claim 1, further comprising a counter for detecting the rotation of the rotor and counting rotation turns of the rotor.

6. The wrist exerciser as claimed in claim 5, wherein the casing comprises a bottom opening and wherein the counter comprises a surface which is attached to the bottom opening of the casing, the surface having a photo sensor mounted thereon to be corresponding to the light generation means and actuateable by the light emitted by the light generation means so as to obtain the rotation turns of the rotor, the counter comprising a display to show number of the rotation turns.

7. The wrist exercise as claimed in claim 5, wherein the casing comprises a bottom opening and wherein the counter comprises a surface which is attached to the bottom opening of the casing, the surface having a proximity detector mounted thereon to be corresponding to and actuateable by a magnet fixed in the groove of rotor so as to obtain the rotation turns of the rotor, the counter comprising a display to show number of the rotation turns.

8. The wrist exerciser as claimed in claim 5, wherein the casing comprises a bottom opening and wherein the counter comprises a surface which is attached to the bottom opening of the casing, the surface having a photo sensor mounted thereon to be corresponding to the light generation means and actuateable by the light emitted by the light generation means so as to obtain the rotation turns of the rotor in a first range of rotational speed of the rotor, the counter further comprising a proximity detector mounted on the surface thereof to be corresponding to and actuateable by a magnet fixed in the groove of the rotor so as to obtain the rotation turns of the rotor in a second range of the rotational speed of the rotor, the speed of the second speed range being smaller than that of the first speed range, the counter comprising a display to show number of the rotation turns.

9. The wrist exerciser as claimed in claim 1, wherein the rotor comprises a central bore substantially co-axial with the central axis of the rotor with at least one partition plate fixed therein to divide the bore into a plurality of chambers serving to generate a sound during the rotation of the rotor.

10. The wrist exerciser as claimed in claim 9, wherein the rotor has at least two partition plates intersecting each other along the central axis fixed in the central bore thereof to divide the bore into a plurality of chambers serving to generate a sound during the rotation of the rotor.

11. The wrist exerciser as claimed in claim 9, wherein each of the chambers comprises a weight block fixed therein.

12. The wrist exerciser as claimed in claim 2, wherein the lighting elements comprise light emitting diodes.

13. The wrist exerciser as claimed in claim 2, wherein the lighting elements emit lights of different colours.

14. The wrist exerciser as claimed in claim 2, wherein the light generation means comprises four lighting elements equally spaced along the groove.

15. A wrist exerciser comprising a spherical casing having a first axis and a second axis substantially perpendicular to each other, a ring received within the spherical casing to be concentric with and rotatable about the first axis with respect to the casing and a spherical rotor received within the ring and having a rotational axis co-linear with the second axis to be rotatable about the second axis with respect to both the casing and the ring, the rotor having an outer surface on which a circumferential groove is formed with a driving hole formed in the groove, a flexible rope having a rigid end receivable in and engageable with the driving hole, the flexible rope being windable around the outer surface of the rotor along the groove through a top opening formed on the casing so that the rotor is driven to rotate about the second axis by pulling to unwind the rope from the rotor, a counter being provided to count the rotations of the rotor about the second axis.

16. The wrist exerciser as claimed in claim 15, wherein the casing comprises a bottom opening and wherein the counter comprises a surface which is attached to the bottom opening of the casing, the surface having a photo sensor mounted thereon to be corresponding to a light generation device mounted within the groove for generating a light and actuateable by the light emitted by the light generation device so as to obtain the rotation turns of the rotor, the counter comprising a display to show number of the rotation turns.

17. The wrist exercise as claimed in claim 15, wherein the casing comprises a bottom opening and wherein the counter comprises a surface which is attached to the bottom opening of the casing, the surface having a proximity detector mounted thereon to be corresponding to and actuateable by a magnet fixed in the groove of rotor so as to obtain the rotation turns of the rotor, the counter comprising a display to show number of the rotation turns.

18. The wrist exerciser as claimed in claim 15, wherein the casing comprises a bottom opening and wherein the counter comprises a surface which is attached to the bottom opening of the casing, the surface having a photo sensor mounted thereon to be corresponding to a light generation device mounted within the groove for generating a light and actuateable by the light emitted by the light generation means so as to obtain the rotation turns of the rotor in a first range of rotational speed of the rotor, the counter further comprising a proximity detector mounted on the surface thereof to be corresponding to and actuateable by a magnet fixed in the groove of rotor so as to obtain the rotation turns of the rotor in a second range of the rotational speed of the rotor, the speed of the second speed range being smaller than that of the first speed range, the counter comprising a display to show number of the rotation turns.

19. The wrist exerciser as claimed in claim 18, wherein the light generation device comprises electrically driving lighting elements disposed in the groove and electrical generator means which supplies an electrical current to the lighting elements.

20. The wrist exerciser as claimed in claim 19, wherein the generator means comprises at least one coil of conductive wire fixed on the rotor to be in electrical connection with the lighting elements and a magnet fixed to the ring and having magnetic line of force, the magnet being positioned corresponding to the rotor so that the rotation of the rotor moves the coil to cut through the magnetic line of force of the magnet and thus induce an electrical current in the conductive wire of the coil which is supplied to power the lighting elements.

* * * * *

UNITED STATES PATENT AND TRADEMARK OFFICE

CERTIFICATE OF CORRECTION

PATENT NO. : 5,800,311
APPLICATION NO. : 08/984043
DATED : September 1, 1998
INVENTOR(S) : P. S. Chuang It is certified that error appears in the above-identified patent and that said Letters Patent is hereby corrected as shown below:

Section [57] ABSTRACT

Line 21 and 22 the word “actuaeable” should say “actuatable” in both instances;

Column 1, Line 10

The word “counting” should be “count”;

Column 1, Line 10

A word “a” should be added before “light generation device”;

Column 2, Lines 39 and 40

The word “actuaeable” should say “actuatable” in both instances;

Column 3, Line 46

The word “actuaeable” should say “actuatable”;

Column 4, Line 4

The word “fast” should be “faster”;

Column 5, Line 21

The word “an” should be deleted;

Column 5, Line 57

The word “tiny” should be “little”;

Signed and Sealed this
Seventh Day of August, 2012

David J. Kappos

David J. Kappos
*Director of the United States Patent and Trademark Office*

Column 6, Line 24

"the rotor, light" should say "the rotor, and light";

Column 6, Line 53, Claim 6

The word "actuaeable" should say "actuatable";

Column 6, Line 55, Claim 6

The phrase "show number" should be "show the number";

Column 6, Line 57, Claim 7

The word "wrist exercise" should say "wrist exerciser";

Column 6, Line 61, Claim 7

The word "actuaeable" should say "actuatable;

Column 6, Line 62, Claim 7

The phrase "the groove of rotor" should say "the groove of the rotor";

Column 6, Line 64, Claim 7

The phrase "show number" should be "show the number";

Column 7, Line 3, Claim 8

The word "actuateable" should be "actuatable";

Column 7, Line 7, Claim 8

The word "actuateable" should be "actuatable";

Column 7, Line 12, Claim 8

The phrase "show number" should be "show the number";

Column 7, Line 46, Claim 15

The phrase "from the rotor, a counter" should be "from the rotor, and a counter";

Column 8, Line 5, Claim 15

The word "actuateable" should be "actuatable";

Column 8, Line 7, Claim 16

The phrase "show number" should be "show the number";

Column 8, Line 9, Claim 17

The word “exercise” should be “exerciser”;

Column 8, Line 13, Claim 17

The word “actuateable” should be “actuatable”;

Column 8, Line 14, Claim 17

The phrase “the groove of rotor” should be “the groove of the rotor”;

Column 8, Line 23, Claim 18

The word “actuateable” should be “actuatable”;

Column 8, Line 24, Claim 18

The word “means” should be “device”;

Column 8, Line 27, Claim 18

The word “actuateable” should be “actuatable”;

Column 8, Line 28, Claim 18

The phrase “the groove of rotor” should be “the groove of the rotor”;

Column 8, Line 32, Claim 18

The phrase “show number” should be “show the number”.

UNITED STATES PATENT AND TRADEMARK OFFICE

CERTIFICATE OF CORRECTION

PATENT NO. : 5,800,311
APPLICATION NO. : 08/984043
DATED : September 1, 1998
INVENTOR(S) : P. S. Chuang It is certified that error appears in the above-identified patent and that said Letters Patent is hereby corrected as shown below:

Column 6, Line 20

The phrase "the driving hole. The" should be replaced with "the driving hole, the".

Signed and Sealed this
Fourth Day of September, 2012

David J. Kappos

David J. Kappos
*Director of the United States Patent and Trademark Office*